US008172595B2

(12) United States Patent
Bartholoma et al.

(10) Patent No.: US 8,172,595 B2
(45) Date of Patent: May 8, 2012

(54) CONNECTOR IMPERMEABLE TO LIQUIDS

(75) Inventors: Mario Bartholoma, Winden (DE); Fritz Zugel, Waldkirch (DE); Volker Gotz, Kenzingen (DE); Achim Hoch, Waldkirch (DE); Gunter Reich, Elzach (DE)

(73) Assignee: Hummel AG, Denzlingen (DE)

( * ) Notice: Subject to any disclaimer, the term of this patent is extended or adjusted under 35 U.S.C. 154(b) by 170 days.

(21) Appl. No.: 12/744,935

(22) PCT Filed: Dec. 3, 2008

(86) PCT No.: PCT/EO2008/010232

§ 371 (c)(1),
(2), (4) Date: May 27, 2010

(87) PCT Pub. No.: WO2009/071278

PCT Pub. Date: Jun. 11, 2009

(65) Prior Publication Data

US 2010/0304593 A1 Dec. 2, 2010

(30) Foreign Application Priority Data

Dec. 5, 2007 (DE) ..... 20 2007 016 950 U

(51) Int. Cl.
*H01R 4/38* (2006.01)

(52) U.S. Cl. ..... 439/277; 439/320

(58) Field of Classification Search ..... 439/277, 439/271, 320, 181, 186
See application file for complete search history.

(56) References Cited

U.S. PATENT DOCUMENTS 2,002,177 A * 5/1935 Hastings ..... 439/187
2,616,942 A * 11/1952 Simpson et al. ..... 439/320
2,889,158 A 6/1959 Hughes-Caley
3,125,394 A * 3/1964 Appleton ..... 439/142
3,305,249 A * 2/1967 Zahuranec ..... 285/24
3,312,928 A * 4/1967 Nava et al. ..... 439/180
3,860,315 A * 1/1975 Tetreault et al. ..... 439/186
4,198,110 A * 4/1980 Wetmore et al. ..... 439/321
4,376,563 A * 3/1983 Margrave et al. ..... 439/358

(Continued)

FOREIGN PATENT DOCUMENTS

DE 202007002041 7/2007

(Continued)

*Primary Examiner* — Neil Abrams
(74) *Attorney, Agent, or Firm* — Volpe and Koenig, P.C.

(57) ABSTRACT

A connector (1) impermeable to liquids, having two matching connector parts (3) and (5), which is sealed in a connected position by at least one peripherally extending circumferential sealing ring (6) provided between the connector pats (3) and (5). The plug-in position is secured by a rotatable, axially fixed threaded bushing (8), which is fixed in the axial direction, but rotatably supported on one of the connector parts, and the internal thread (9) of which is mated to the holding thread (10) on the other connector part. A further thread or projection or threaded part (12) mating with the interior thread (9) is provided in a loosening direction at a distance from the holding thread (10) interacting with the threaded bushing (8), and a distance A from the end of the holding thread (10) to that of the further thread (12) is greater than a plug-in depth of the connecting pins (2) into the bushings (4). The sealing ring (6) for both connector parts is disposed at a location at which it is still in the sealing position after pulling back the threaded bushing (8) that is detached from the holding thread (10). Any sparks occurring upon loosening of the contacts are therefore shielded from the environment.

5 Claims, 3 Drawing Sheets

U.S. PATENT DOCUMENTS

| | | | | |
|---|---|---|---|---|
| 4,478,474 | A | 10/1984 | Gallusser et al. | |
| 4,808,127 | A * | 2/1989 | Swanic | 439/139 |
| 5,167,518 | A * | 12/1992 | Deacon | 439/188 |
| 5,971,786 | A * | 10/1999 | Beck | 439/320 |
| 7,794,252 | B2 * | 9/2010 | Sauer et al. | 439/186 |
| 2009/0170364 | A1 * | 7/2009 | Scholler et al. | 439/359 |

FOREIGN PATENT DOCUMENTS

| | | |
|---|---|---|
| EP | 0883214 | 12/1998 |

* cited by examiner

CONNECTOR IMPERMEABLE TO LIQUIDS

BACKGROUND

The invention is directed to a connector that is impermeable to liquids having a first connector part, comprising a connector pin, and having a second connector part, comprising bushings matching the connector pin of the first connector part, with the connector, in the plug-in position, being sealed from any liquids accessing the connector pins and bushings by at least one peripherally extending circumferential sealing ring between the connector parts, and the plug-in position is secured by a rotational, axially fixed threaded bushing, which is supported at one of the connector parts fixed in the axial direction but rotational, and with its internal thread matching the fastening thread of the other connector part.

A plug-in connector of this type is known from EP 0 883 214 B1.

In such connectors the loosening of the two connector parts from each other can lead to difficulties in an environment where there is a risk of explosion, because when loosening the plug-in connection sparks can develop which may not have any effect in such an environment, though.

SUMMARY

Therefore, the object is to provide a connector of the type noted at the outset, in which any sparks developing during the loosening of the connection cannot lead to an explosion.

In order to attain this object, the connector of the type defined at the outset is characterized in at least one additional turn of a thread or projection or threaded part being provided at a distance from the fastening thread cooperating with the threaded bushing, in the loosening direction, matching the internal thread of the threaded bushing such that the distance of the end of the holding thread from the additional projection or turn of the thread or threaded part is greater than the plug-in depth of the connector pins in the bushings and that at least one sealing ring for the two connector parts is arranged at a position at which, after the retraction of the threaded bushing loosened from the holding thread, it is still in the sealing position up to the additional projection or turn of the thread or threaded part.

Thus another threaded arrangement is provided in the axial direction, at a distance from the holding thread, which must be overcome by the threaded bushing before the sealing connection of the two connector parts is finally loosened. This way, the user first can loosen the threaded bushing, then pull apart the plug-in connection in the axial direction, but without finally being able to separate the two connector parts. Thus, they remain connected in a sealed fashion so that when loosening the actual plug-in connection any sparks developing cannot interact with the environment of the connector. Only in another rotational process, in which the threaded bushing overcomes the separate threaded section, the plug-in connection can be finally separated. The time necessary here is long enough to prevent any sparks from being effective. Thus, according to the invention it is ensured that any sparks occurring when pulling apart the connector parts remain inside said connector parts and are separated or shielded from the environment by the seal, before any additional rotational motion finally separates the connector parts from each other.

It may be beneficial for the internal thread of the threaded bushing to have fewer turns than the holding thread at the connector part cooperating therewith. This way, a minimum number of threaded connections is required to execute the first separating motion, after which the two connector parts can be pulled apart in the axial direction and their contact become separated.

The additional projection may comprise more than one thread or two threads, in order to allow a secure screwing of this last connection without risking any jamming. In spite thereof, sufficient security is given against any early separation of the two connector parts.

The axial space between the holding thread and the additional projection or turn of the thread or threaded part may for example also be formed by way of a material-reducing or cutting process of the originally continuous thread. It is therefore possible to first provide a continuous thread, extending over the intermediate space, and then subsequently to form the axial distance, for example by way of a cutting process, thus ensuring that the turns of the holding thread and the turn or turns of the thread of the additional projection match each other.

Primarily when combining one or more of the above-mentioned features and measures, a connector develops that is impermeable to liquids, which can also be loosened in a potentially explosive environment, because any sparks developing during the separation of the contacts cannot cooperate with this environment because at the time of the separation of the contacts the connector parts remain connected in a gas and/or liquid-tight fashion and lie upon and engage each other.

BRIEF DESCRIPTION OF THE DRAWINGS

In the following, an exemplary embodiment of the invention is explained in greater detail using the drawing. It shows in a partially schematic illustration.

DETAILED DESCRIPTION OF THE PREFERRED EMBODIMENTS

Figure 2:
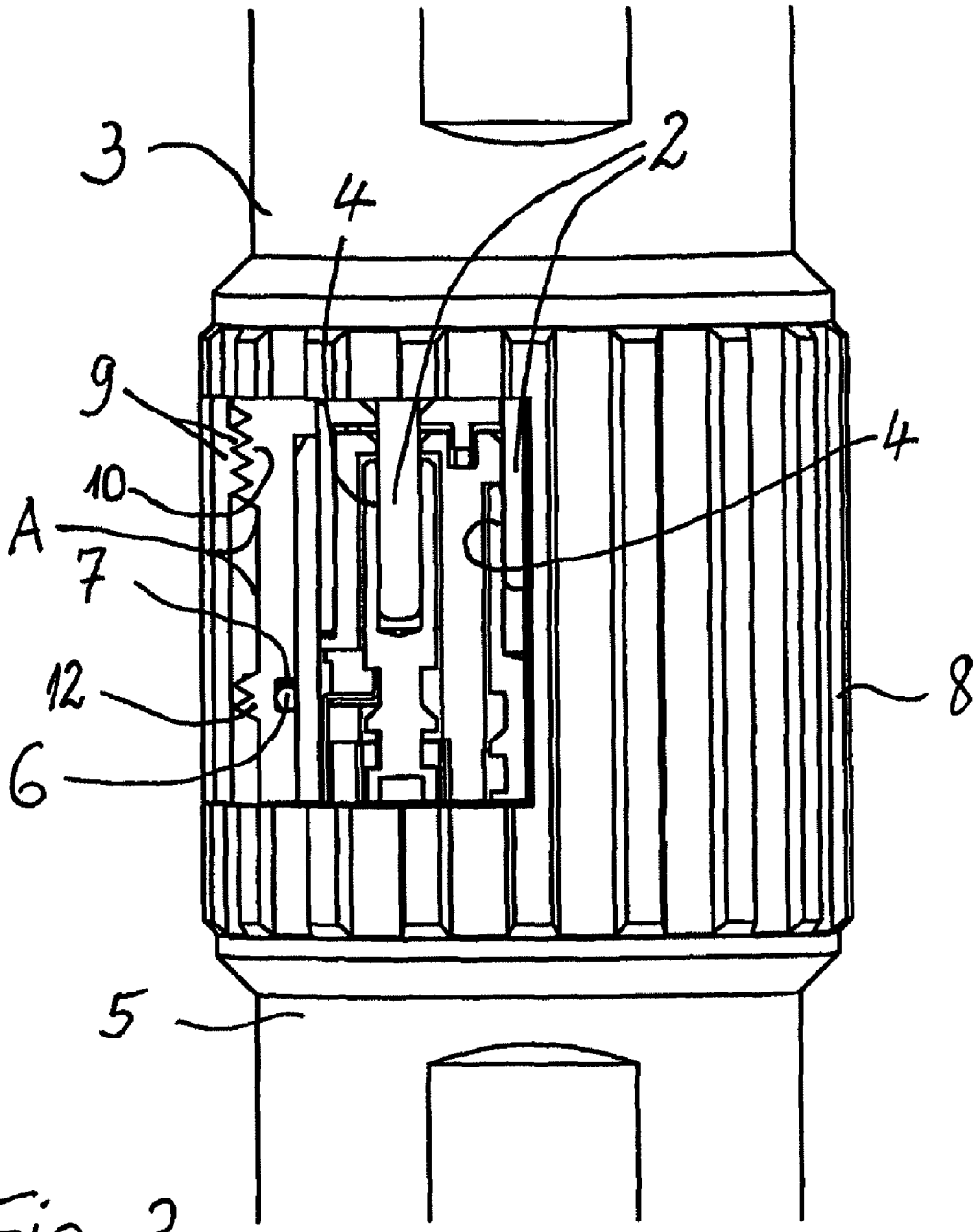
Figure 3:
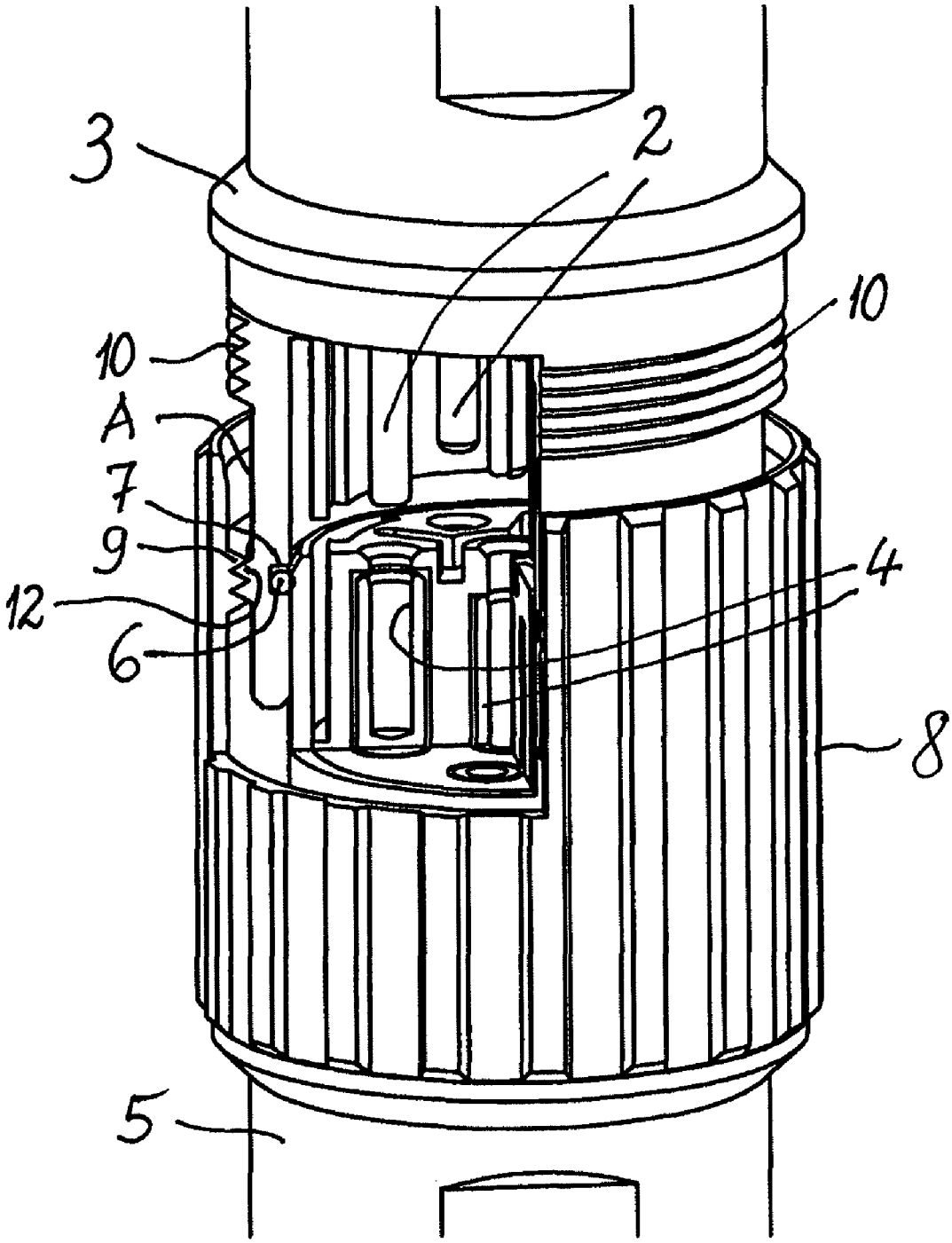

A connector impermeable to liquids, in its entirety marked 1, comprises a first connector part 3, having connector pins 2 as discernible in FIGS. 2 and 3, and a second connector part 5, having bushings 4 matching the connector pins 2, which connector parts 3 and 5 can be plug-connected according to FIGS. 2 and 3.

In the connected position according to FIG. 2, the connector 1 is sealed from any liquids reaching the connector pins 2 and bushings 4 by a circumferential sealing ring 6 between the connector parts 3 and 5, with said sealing ring 6 being positioned peripherally circumferential in the interior circular groove 7 of the second connector part 5 and contacting the exterior of the first connector part 3 in a sealing fashion. This is clearly discernible in FIGS. 2 and 3.

The plug-in position is here secured by a rotational, axially fixed threaded bushing 8, which is supported at one of the connector parts, in the exemplary embodiment at the second connector part 5, fixed in the axial direction but rotational, and with its internal thread 9 matching the holding thread 10 of the other connector part, in the exemplary embodiment the connector part 3, and cooperating in the operational position according to FIG. 2.

Figure 1:
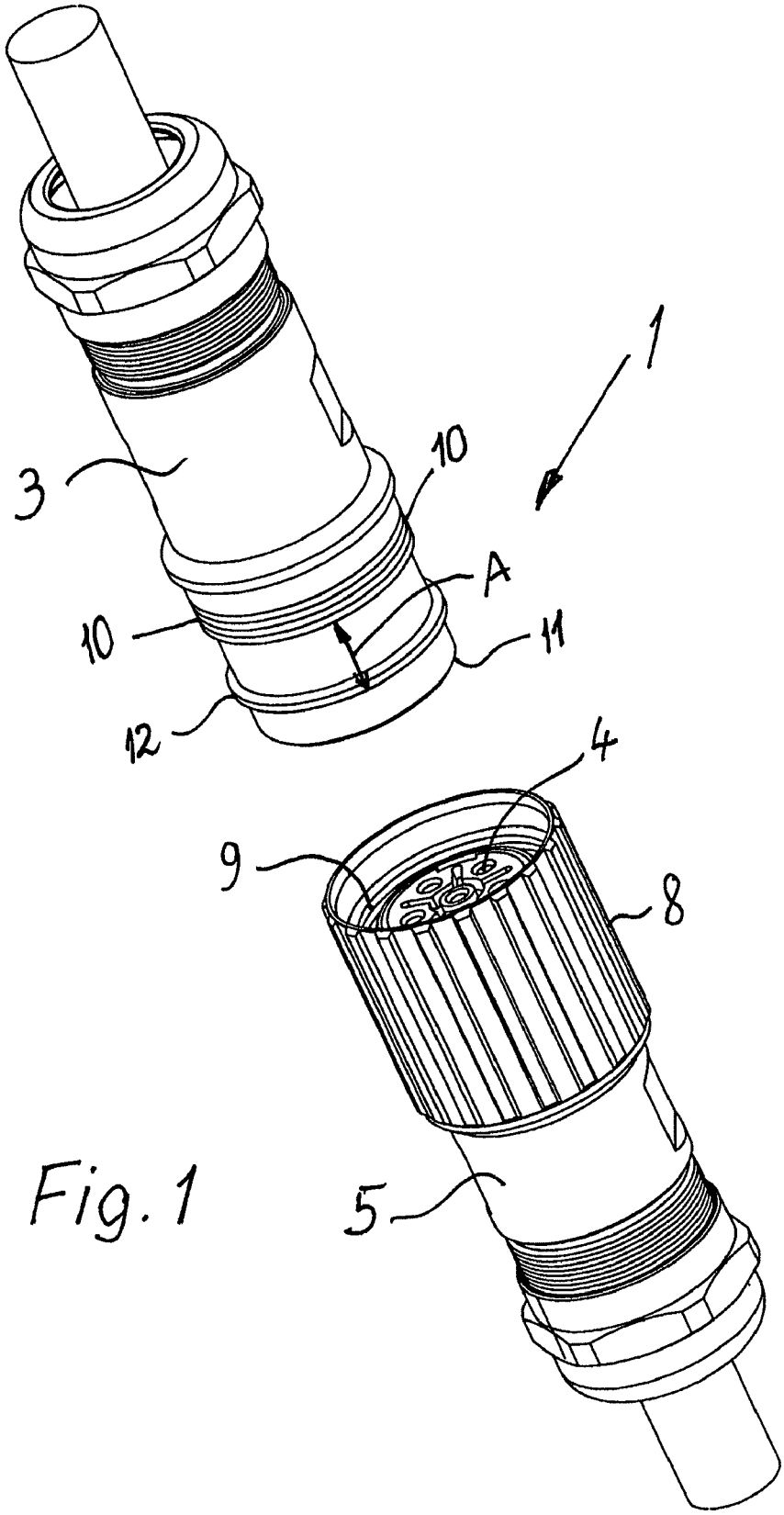
FIG. 1 the two connector parts of a connector impermeable to liquids prior to their mutual connection or after their separation, with a threaded bushing being arranged rotational but axially fixed at the second connector part, comprising plug-in connector bushings for connector pins, with its internal thread matching a holding thread at the first connector part, FIG. 2 in an enlarged scale and partially in a longitudinal cross-section, the connecting section of the connector according to the invention, with the threaded bushing engaging the first connector part with its internal thread at its holding thread and with its connector pins being inserted into the bushings of the second connector part, with a sealing ring, inserted into an interior circumferential groove of the second connector part cooperating with the exterior of the first connector part in a sealing fashion, and FIG. 3 an illustration according to FIG. 2 after the loosening of the threaded bushing from the holding thread, with the internal thread of the threaded bushing cooperating with a threaded part having such a distance from the holding thread that in this position the connector pins and the bushings are no longer in contact with each other, yet the sealing ring still sealing the interior of the connector.

In FIG. 1, but also in FIGS. 2 and 3 it is clearly discernible that in the loosening direction, at a distance A from the holding thread 10 cooperating with the threaded bushing 8, i.e. closer to the face 11 of the connector part 3, an additional turn of the thread or projection or threaded part 12 is provided, matching the internal thread 9 of the threaded bushing 8, in the following simply called "threaded part 12."

This distance or gap between the ends of the holding thread 10 and the threaded part 12 is marked A in FIG. 1. Here, this distance A is greater than the insertion depth of the connector pins 2 into the bushings 4, i.e. the separating process of the two connector parts 3 and 5 from each other has not been completed when the mutual contacts, i.e. the pins 2 and the bushings 4, have already been separated as shown in FIG. 3. This way, any sparks developing when separating the contacts cannot get into an effective connection with the environment and risk an explosion because the sealing ring 6 is still effective; namely the sealing ring is arranged at a position at which, after the retraction of the threaded bushing 8, separated from the holding thread 10, it remains in a sealing state, together with the connector part 5 carrying it, until it reaches the additional threaded part 12.

In the exemplary embodiment, the internal thread 9 of the threaded bushing 8 has fewer turns than the holding thread 10 at the connector part 3. In the operating state the screwed connection is appropriately secure.

In the exemplary embodiment, the additional projection or threaded part 12 has more than one thread, for example two threads. This threaded connection is appropriately effective between the connector part 3 and the connector part 6 at a position where the contacts are separated but the interior space of the connector 1 is still sealed in a gas or liquid-tight fashion.

The clear distance between the holding thread 10 and the additional projection or threaded part 12 is smaller, by the axial extension of said threaded part 12, than the distance A between the ends of these two threaded sections and for safety reasons or beneficially it may be equivalent or even greater than the insertion depth of the connector pins 2 into the bushings 4, so that the separation of the connector parts has already occurred before the threaded bushing 8 on the threaded part 12 is rotated for a final separation of the connector parts and is screwed over it. However, it is sufficient for the distance A, including the axial extension of the threaded part 12, to be sufficiently large to ensure that the contacts of the connector parts 3 and 5 are separated before the threaded bushing 8 is finally loosened.

The space A between the holding thread 10 and the threaded part 12 is formed by a material removing process applied to an originally continuous thread, which initially comprised the holding thread 10 and the threaded part 12.

It is accordingly assured that the interior thread 9 of the threaded bushing 8 matches both the holding thread 10 as well as the additional threaded part 12.

The connector 1, impermeable to liquids, having two matching connector parts 3 and 5 is sealed in the inserted position by at least one sealing ring 6 peripherally circumferential between the connector parts 3 and 5. The inserted position is secured by a rotational, axially fixed threaded bushing 8, which is supported at one of the connector parts fixed in the axial direction but rotational, and with its internal thread 9 matching the holding thread 10 at the other connector part. In the loosening direction, an additional turn of the thread or projection or threaded part 12 is provided, matching the internal thread 9, at a distance from the holding thread 10 cooperating with the threaded bushing 8, with the distance A from the end of the holding thread 10 to the additional thread 12 being greater than the insertion depth of the connector pins 2 into the bushings 4. The sealing ring 6 for the two connector parts is arranged at a position at which, after the retractions of the threaded bushing 8 loosened from the holding thread 10, it is still in a sealing state. Any sparks developing when loosening the contacts are therefore shielded from the environment.

The invention claimed is:

1. A connector impermeable to liquids (1) comprising a first connector part (3) having connector pins (2) and a second connector part (5) having bushings (4) matching the connector pins (2), with the connector (1) in a plug-in position being sealed from liquids accessing the connector pins (2) and the bushings (4) by at least one peripherally extending circumferential sealing ring (6) located between the connector parts (3, 5), and the plug-in position being secured by a rotational, axially fixed threaded bushing (8), which is supported axially fixed but rotational on one of the connector parts and with an internal thread (9) thereof matching a holding thread (10) on the other connector part, at least one additional turn of thread or projection or threaded part (12) is provided in a loosening direction at a distance from an end of the holding thread (10), that cooperates with the threaded bushing (8) and matches the internal thread (9) of the threaded bushing (8), the distance (A) from the end of the holding thread (10) to the additional projection or turn of the thread or threaded part (12) is greater than an insertion depth of the connector pins (2) in the bushings (4), and the at least one sealing ring (6) for the two connector parts is arranged at a position at which, after retraction of the threaded bushing (8) loosened from the holding thread (10), it remains in a sealing position up to the additional projection or turn of the thread or threaded part (12).

2. A connector according to claim 1, wherein the internal thread (9) of the threaded bushing (8) has fewer turns of thread than the holding thread (10) at the connector part (3).

3. A connector according to claim 1, wherein the additional projection comprises more than one thread or two threads.

4. A connector according to claim 1, wherein a clear space between the holding thread (10) and the additional projection or turn of the thread or threaded part (12) is formed by a material-removing or cutting process of an originally continuous thread.

5. A connector according to claim 1, wherein a clear space between the holding thread (10) and the additional projection or threaded part (12) is equivalent or greater than an insertion depth of the connector pins (2) in the bushings (4).

* * * * *